US007334426B2

(12) United States Patent
Yoshimi et al.

(10) Patent No.: US 7,334,426 B2
(45) Date of Patent: Feb. 26, 2008

(54) REFRIGERATING APPARATUS

(75) Inventors: Atsushi Yoshimi, Osaka (JP); Manabu Yoshimi, Osaka (JP); Kazuhide Mizutani, Osaka (JP); Hiromune Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 351 days.

(21) Appl. No.: 10/545,705

(22) PCT Filed: Nov. 24, 2004

(86) PCT No.: PCT/JP2004/017400

§ 371 (c)(1),
(2), (4) Date: Aug. 17, 2005

(87) PCT Pub. No.: WO2005/052472

PCT Pub. Date: Jun. 9, 2005

(65) Prior Publication Data

US 2006/0150664 A1 Jul. 13, 2006

(30) Foreign Application Priority Data

Nov. 25, 2003 (JP) ..... 2003-394236
Feb. 3, 2004 (JP) ..... 2004-026881

(51) Int. Cl.
*F25D 19/00* (2006.01)

(52) U.S. Cl. ..... 62/475; 62/298

(58) Field of Classification Search ..... 62/298, 62/471, 475, 503
See application file for complete search history.

(56) References Cited

U.S. PATENT DOCUMENTS 3,765,192 A * 10/1973 Root ..... 62/324.6
4,305,257 A * 12/1981 Kneeland ..... 62/54.1

FOREIGN PATENT DOCUMENTS

| | | | |
|---|---|---|---|
| EP | 0 952 407 | A2 | 10/1999 |
| JP | 7-83545 | A | 3/1995 |
| JP | 2000-329432 | A | 11/2000 |
| JP | 2001-141340 | A | 5/2001 |
| JP | 2002-107011 | A | 4/2002 |

* cited by examiner

*Primary Examiner*—Melvin Jones
(74) *Attorney, Agent, or Firm*—Birch, Stewart, Kolasch & Birch, LLP

(57) ABSTRACT

The capacity of a compressor (21) in cleaning operation is set based on a Froude number Fr. The Froude number Fr expresses a ratio of an inertial force of a gas refrigerant flowing through a gas side communication pipe (70) to a gravity working on a liquid in the gas side communication pipe (70). The capacity of the compressor (21) in the cleaning operation is set so that the Froude number Fr is larger than 1, whereby the inertial force of the gas refrigerant flowing through the gas side communication pipe (70) becomes larger than the gravity working on the liquid in the gas side communication pipe (70) which contains mineral oil and foreign matters. In this connection, the liquid containing the mineral oil and the foreign matters is pushed up by the gas refrigerant even in a perpendicularly extending portion of the gas side communication pipe (70). Thus, the mineral oil and the foreign matters remaining in the existing liquid side communication pipe (60) and the existing gas side communication pipe (70) are recovered.

7 Claims, 3 Drawing Sheets

REFRIGERATING APPARATUS

TECHNICAL FIELD

The present invention relates to a refrigerating apparatus connected to existing communication pipes for performing cleaning operation of the communicating pipes.

BACKGROUND ART

Conventionally, a refrigerating apparatus is known which includes a refrigerant circuit that performs vapor compression refrigeration cycle by circulating a refrigerant. This refrigerating apparatus is composed of indoor and outdoor units connected with each other through communication pipes. The communication pipes are buried inside a building in many cases. This causes difficulty in exchanging the communication pipes at renewal of the refrigerating apparatus, necessitating introduction of a new refrigerating apparatus using the existing communication pipes.

Meanwhile, a CFC refrigerant and an HCFC refrigerant, which had been employed as a refrigerant filled in a refrigerant circuit until now, have been abolished because they causes adverse influence over environment (destruction of the ozone layer and the like). For this reason, it is required to connect a refrigerating apparatus using an HFC refrigerant or the like, which is a novel refrigerant, to the existing communication pipes that have used the CFC refrigerant or the HCFC refrigerant. However, the existing communication pipes include residual mineral oil of refrigerating machine oil for the CFC refrigerant or the HCFC refrigerant. Acids and ions generated due to degradation of the CFC refrigerant, the HCFC refrigerant, and the mineral oil may invite corrosion of an expansion valve and the like. Therefore, it is necessary to remove the mineral oil by cleaning the existing communication pipes before test run for a newly introduced refrigerating apparatus.

In this connection, a refrigerating apparatus capable of cleaning such existing communication pipes has been proposed (for example, see Patent Document 1). In this refrigerating apparatus, a refrigerant circuit is composed in such a fashion that a heat source unit including a compressor and a heat source side heat exchanger is connected to an indoor unit including a user side heat exchanger through first and second connection pipes as the existing communication pipes. On the suction side of the compressor, foreign matter catching means is provided for separating and recovering mineral oil and foreign matters from a refrigerant. The refrigerating apparatus performs cleaning operation in a cooling operation mode after an HFC refrigerant is filled to clean the first and second connection pipes by the refrigerant circulating in the refrigerant circuit, thereby recovering the mineral oil and the foreign matters.

Patent Document 1: Japanese Patent Application Laid Open Publication No. 2000-329432A

DISCLOSURE OF THE INVENTION

Problems that the Invention is to Solve

Referring to air conditioners as one type of refrigerating apparatuses, for example, many of them have the outdoor unit and the indoor unit different in height between their installed positions. In such a case, a portion extending in a perpendicular direction is formed in each communication pipe for connecting the outdoor unit and the indoor unit.

For removing the mineral oil and the foreign matters which remain in the communication pipes on the gas side, it is necessary to push and flow the mineral oil and the foreign matters by the flow of a gas refrigerant. Especially, it is required to push upward the mineral oil and the foreign matters by the gas refrigerant in the perpendicularly extending portion of the communication pipe on the gas side.

However, the conventional refrigerating apparatuses take less or no consideration of an operation condition during the cleaning operation. For this reason, the flow rate of the gas refrigerant in the communication pipe on the gas side is too low to push and flow the mineral oil and the foreign matters in some operation conditions, leaving the mineral oil and the foreign matters in the communication pipes to cause troubles.

The present invention has been made in view of the above problems and has its object of obviating troubles in a refrigerating apparatus that performs cleaning operation of existing communication pipes by surely reducing a residual amount of mineral oil and foreign matters in the communication pipes.

Means of Solving the Problems

Problem solving means that the present invention provides will be described.

The first and second problem solving means direct to a refrigerating apparatus which includes a heat source side circuit (11) which is provided with a compressor (21) and a heat source side heat exchanger (24) and which is connected to a user side heat exchanger (33) by means of an existing liquid side communication pipe (60) and an existing gas side communication pipe (70), and which performs cleaning operation for removing refrigerating machine oil for an old refrigerant from the existing liquid side communication pipe (60) and the existing gas side communication pipe (70) by operating the compressor (21).

In the first problem solving means, an operation condition in the cleaning operation is set based on a Froude number Fr expressed by an expression $Fr=(d_g/d_l)\times(U^2/gD)$ where U is a velocity of a gas refrigerant flowing through the gas side communication pipe (70), D is an inner diameter of the gas side communication pipe (70), $d_g$ is a density of the gas refrigerant flowing through the gas side communication pipe (70), $d_l$ is a density of a liquid existing in the gas side communication pipe (70), and g is a gravitational acceleration.

In the second problem solving means, the gas side communication pipe (70) which is connected to the heat source side circuit (11) of the refrigerant apparatus is composed of a plurality of branch pipes (71) respectively connected to a plurality of user side heat exchangers, and a stem pipe (72) to which the plurality of branch pipes (71) are connected, and an operation condition in the cleaning operation is set based on a Froude number Fr expressed by an expression $Fr=(d_g/d_l)\times(U^2/gD)$ where U is a velocity of a gas refrigerant flowing through the stem pipe (72) of the gas side communication pipe (70), D is an inner diameter of the stem pipe (72), $d_g$ is a density of the gas refrigerant flowing through the stem pipe (72), $d_l$ is a density of a liquid existing in the stem pipe (72), and g is a gravitational acceleration.

The third and fourth problem solving means direct to a refrigerating apparatus which includes: a heat source side circuit (11) which is provided with a compressor (21) and a heat source side heat exchanger (24) and which is connected to a user side heat exchanger (33) by means of an existing liquid side communication pipe (60) and an existing gas side communication pipe (70); and a recovery container (40)

which is provided on a suction side of the compressor (21) in the heat source side circuit (11) and which traps refrigerating machine oil separated from the gas refrigerant, and which performs cleaning operation for recovering refrigerating machine oil for the old refrigerant remaining in the existing liquid side communication pipe (60) and the existing gas side communication pipe (70) to the recovery container (40) by operating the compressor (21).

In the third problem solving means, an operation condition during the cleaning operation is set based on a Froude number Fr expressed by an expression $Fr=(d_g/d_l)\times(U^2/gD)$ where U is a velocity of a gas refrigerant flowing through the gas side communication pipe (70), D is an inner diameter of the gas side communication pipe (70), $d_g$ is a density of the gas refrigerant flowing through the gas side communication pipe (70), $d_l$ is a density of a liquid existing in the gas side communication pipe (70), and g is a gravitational acceleration.

In the fourth problem solving means, the gas side communication pipe (70) which is connected to the heat source side circuit (11) of the refrigerant apparatus is composed of a plurality of branch pipes (71) respectively connected to a plurality of user side heat exchangers, and a stem pipe (72) to which the plurality of branch pipes (71) are connected, and an operation condition in the cleaning operation is set based on a Froude number Fr expressed by an expression $Fr=(d_g/d_l)\times(U^2/gD)$ where U is a velocity of a gas refrigerant flowing through the stem pipe (72) of the gas side communication pipe (70), D is an inner diameter of the stem pipe (72), $d_g$ is a density of the gas refrigerant flowing through the stem pipe (72), $d_l$ is a density of a liquid existing in the stem pipe (72), and g is a gravitational acceleration.

In the fifth problem solving means, the operation condition in the cleaning operation is set so that the Froude number is larger than 1 in the first, second, third, or fourth problem solving means, In the sixth problem solving means, the operation condition in the cleaning operation is set so that the Froude number is 1.5 or larger in the first, second, third, or fourth problem solving means.

In the seventh problem solving means, the refrigerant filled in the heat source side circuit (11) is a mixed refrigerant containing R32 or a natural refrigerant in the first, second, third, or fourth problem solving means.

Operation

In the first and second problem solving means, the heat source side circuit (11) is connected to the user side heat exchanger (33) through the existing liquid side communication pipe (60) and the existing gas side communication pipe (70). During the cleaning operation for cleaning the existing liquid side communication pipe (60) and the existing gas side communication pipe (70), the compressor (21) of the heat source side circuit (11) is operated to allow the refrigerant to flow through the liquid side communication pipe (60) and the gas side communication pipe (70). During the cleaning operation, also, the refrigerating machine oil for the old refrigerant remaining in the existing liquid side communication pipe (60) and the existing gas side communication pipe (70) is pushed and flown by the refrigerant, thereby being removed from the liquid side communication pipe (60) and the gas side communication pipe (70).

In the third and fourth problem solving means, the heat source side circuit (11) is connected to the user side heat exchanger (33) through the existing liquid side communication pipe (60) and the existing gas side communication pipe (70). During the cleaning operation for cleaning the existing liquid side communication pipe (60) and the existing gas side communication pipe (70), the compressor (21) of the heat source side circuit (11) is operated to allow the refrigerant to flow through the liquid side communication pipe (60) and the gas side communication pipe (70). During the cleaning operation, also, the refrigerating machine oil for the old refrigerant remaining in the existing liquid side communication pipe (60) and the existing gas side communication pipe (70) is flown to the heat source side circuit (11) to be separated from the gas refrigerant, thereby being recovered to the recovery container (40).

In the first and third problem solving means, the Froude number Fr expresses a ratio of an inertial force of the gas refrigerant flowing through the gas side communication pipe (70) to a gravity working on the liquid in the gas side communication pipe (70). In other words, the Froude number Fr expresses a magnitude relationship between the gravity working on the liquid in the gas side communication pipe (70) and the inertial force of the gas refrigerant flowing through the gas side communication pipe (70). These problem solving means set the operation condition in the cleaning operation based on the Froude number Fr.

Further, in the second and fourth problem solving means, the gas side communication pipe (70) is composed of the plurality of branch pipes (71) and one stem pipe (72). The plurality of branch pipes (71) are connected at respective one ends thereof to the plurality of user side heat exchangers (33), respectively, and are connected at the respective other ends thereof to the stem pipe (72). The Froude number Fr in these problem solving means expresses a ratio of an inertial force of the gas refrigerant flowing through the stem pipe (72) of the gas side communication pipe (70) to a gravity working on the liquid in the stem pipe (72). In other words, the Froude number Fr expresses a magnitude relationship between the gravity working on the liquid in the stem pipe (72) of the gas side communication pipe (70) and the inertial force of the gas refrigerant flowing through the stem pipe (72). These problem solving means set the operation condition in the cleaning operation based on the Froude number Fr.

Herein, as the liquid that can exists in the gas side communication pipe (70), there are the refrigerating machine oil for the old refrigerant, the new refrigerant, and the refrigerating machine oil for the new refrigerant. The density $d_l$ of the liquid used in introducing the Froude number Fr is preferably a value of the largest density among the refrigerating machine oil for the old refrigerant, the new refrigerant, and the refrigerating machine oil for the new refrigerant. The thus set vale $d_l$ is necessarily larger than the density of the mixture of the refrigerating machine oil for the old refrigerant, the new refrigerant, and the refrigerating machine oil for the new refrigerant, so that the liquid in the gas side communication pipe (70) is flown out by the gas refrigerant surely.

In the fifth problem solving means, the operation condition in the cleaning operation is set so that the Froude number Fr is larger than 1. As described above, the Froude number Fr expresses a ratio of an inertial force of the gas refrigerant flowing through the gas side communication pipe (70) to a gravity working on the liquid in the gas side communication pipe (70). Accordingly, under the condition that the operation condition is set so that the Froude number Fr is set larger than 1, the inertial force of the gas refrigerant flowing through the gas side communication pipe (70) becomes larger than the gravity working on the liquid in the gas side communication pipe (70).

In the sixth problem solving means, the operation condition in the cleaning operation is set so that the Froude number Fr is 1.5 or larger. As described above, the Froude number Fr expresses a ratio of an inertial force of the gas refrigerant flowing through the gas side communication pipe (70) to a gravity working on the liquid in the gas side communication pipe (70). Accordingly, under the condition that the operation condition is set so that the Froude number Fr is 1.5 or larger, the inertial force of the gas refrigerant flowing through the gas side communication pipe (70) becomes 1.5 times or further larger than the gravity working on the liquid in the gas side communication pipe (70).

In the seventh problem solving means, the mixed refrigerant one of components of which is R32 or a natural refrigerant is filled in the heat source side circuit (11). As the mixed refrigerant containing R32, HFC mixed refrigerants such as R410A and R407C are exemplified. As the natural refrigerant, carbon dioxide ($CO_2$), ammonium ($NH_3$), hydrocarbons such as propane ($C_3H_8$), and the like are exemplified.

EFFECTS OF THE INVENTION

In the present invention, the operation condition in the cleaning operation is set based on the Froude number Fr. Specifically, in the first and third problem solving means, the operation condition in the cleaning operation is set taking account of the Froude number Fr expressing the relationship between the gravity working on the liquid in the gas side communication pipe (70) and the inertial force of the gas refrigerant flowing through the gas side communication pipe (70). Also, in the second and fourth problem solving means, the operation condition in the cleaning operation is set taking account of the Froude number Fr expressing the relationship between the gravity working on the liquid in the stem pipe (72) of the gas side communication pipe (70) and the refrigerant flowing through the stem pipe (72).

The old refrigerant and the refrigerating machine oil for the old refrigerant are solved in each other to flow into the liquid side communication pipe (60) while foreign matters are flown with the liquid-phase old refrigerant. Thus, the total amount of the refrigerant oil for the old refrigerant and the foreign matters which remain in the liquid side communication pipe (60) becomes very small. Further, the liquid refrigerant flowing through the liquid side communication pipe (60) has a specific gravity larger than that of the gas refrigerant flowing through the gas side communication pipe (70) and the inertial force of the liquid refrigerant is larger than that of the gas refrigerant. Accordingly, in the cleaning operation, if the refrigerating machine oil for the old refrigerant and the foreign matters which remain in the gas side communication pipe (70) can be flown out, the refrigerating machine oil for the old refrigerant and the foreign matters which remain in the liquid side communication pipe (60) can be also flown out.

In view of the above, when the operation condition is set based on the Froude number Fr for the liquid and the gas refrigerant in the gas side communication pipe (70) as in the first and third problem solving means, the refrigerating machine oil for the old refrigerant and the foreign matters which remain in the liquid side communication pipe (60) and the gas side communication pipe (70) can be flown out by the refrigerant surely. Further, when the operation condition is set based on the Froude number Fr for the liquid and the gas refrigerant in the stem pipe (72) of the gas side communication pipe (70) as in the second and fourth problem solving means, the refrigerating machine oil for the old refrigerant and the foreign matters which remain in the liquid side communication pipe (60) and the gas side communication pipe (70) composed of the stem pipe (72) and the branch pipes (71) can be flown out by the refrigerant surely.

Hence, according to the present invention, the residual amount of the refrigerating machine oil for the old refrigerant and the foreign matters in the existing communication pipes can be reduced surely by the cleaning operation, obviating troubles caused due to the existence of the refrigerating machine oil for the old refrigerant and the foreign matters.

In the fifth problem solving means, the operation condition in the cleaning operation is set so that the Froude number Fr is larger than 1. Under this condition, the inertial force of the gas refrigerant flowing through the gas side communication pipe (70) becomes larger than the gravity working on the liquid in the gas side communication pipe (70), so that the refrigerating machine oil for the old refrigerant and the foreign matters can be pushed upward by the gas refrigerant even at a perpendicularly extending portion of the gas side communication pipe (70). Thus, with this problem solving means, the residual amount of the refrigerating machine oil for the old refrigerant and the foreign matters in the existing communication pipes can be further reduced.

In the sixth problem solving means, the operation condition in the cleaning operation is set so that the Froude number Fr is 1.5 or larger. Under this condition, the inertial force of the gas refrigerant flowing through the gas side communication pipe (70) becomes 1.5 times or further larger than the gravity working on the liquid in the gas side communication pipe (70), so that the force of the gas refrigerant for pushing upward the refrigerating machine oil for the old refrigerant and the foreign matters increases even at the perpendicularly extending portion of the gas side communication pipe (70). Thus, with this problem solving means, the residual amount of the refrigerating machine oil for the old refrigerant and the foreign matters in the existing communication pipes can be reduces more surely.

EXPLANATION OF REFERENCE NUMERALS

Figure 1:
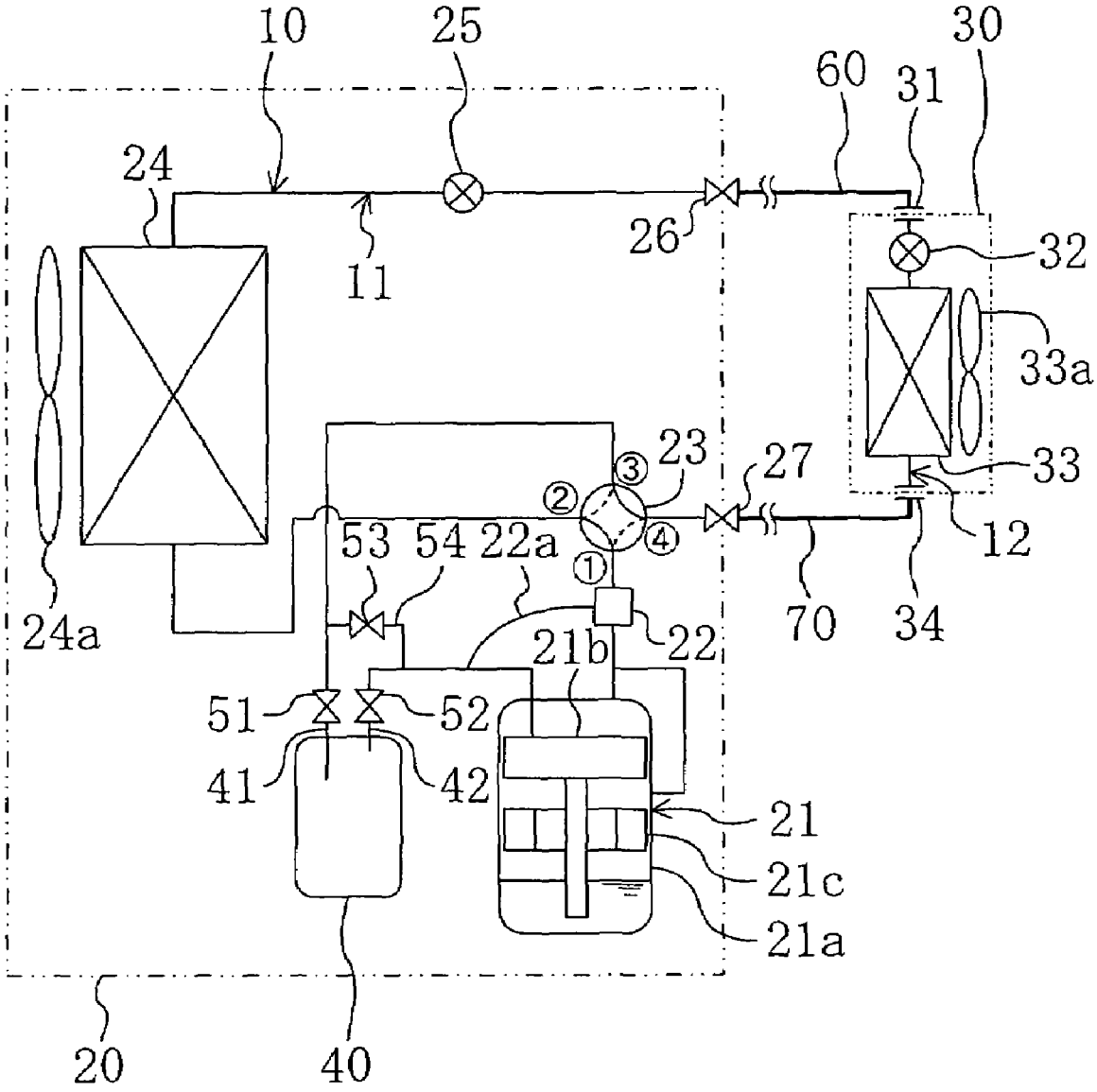
FIG. 1 is a diagram showing a refrigerant circuit of an air conditioner according to Embodiment 1.

11 heat source side circuit (outdoor circuit)

21 compressor

24 heat source side heat exchanger (outdoor heat exchanger)

33 user side heat exchanger (indoor heat exchanger)

40 recovery container

60 liquid side communication pipe

70 gas side communication pipe

71 branch pipe

72 stem pipe

BEST MODE FOR CARRYING OUT THE INVENTION

The Embodiments of the present invention will be described in detail with reference to the drawings.

EMBODIMENT 1

As shown in FIG. 1, an air conditioner of the present embodiment includes one outdoor unit (20) and one indoor unit (30). The outdoor unit (20) and the indoor unit (30) are constituted for an HFC refrigerant. The outdoor unit (20) composes a refrigerating apparatus according to the present invention.

The outdoor unit (20) and the indoor unit (30) are connected with each other by means of an existing liquid side communication pipe (60) and an existing gas side communication pipe (70) which had been respectively connected to an outdoor unit and an indoor unit for a CFC refrigerant or an HCFC refrigerant until then. In the air conditioner of the present invention, a refrigerant circuit (10) is formed by connecting an outdoor circuit (11) of the outdoor unit (20) and an indoor circuit (12) of the indoor unit (30) by means of the existing liquid side communication pipe (60) and the existing gas side communication pipe (70).

The outdoor circuit (11) of the outdoor unit (20) composes a heat source side circuit. In the outdoor circuit (11), a compressor (21), an oil separator (22), a four-way switch valve (23), and an outdoor heat exchanger (24) that serves as a heat source side heat exchanger are connected by refrigerant piping, which is filled with an HFC refrigerant. The outdoor unit (20) is provided also with an outdoor fan (24*a*).

Referring to the HFC refrigerant filled in the outdoor circuit (11), various refrigerants can be listed such as R32, R134a, R404A, R407C, R410A, R507A, a mixed refrigerant of R32 and R125, a mixed refrigerant of R32, R125, and R134a, and a mixed refrigerant containing R32 as a main component, and the like. Not only the HFC refrigerant but also a natural refrigerant of non-fluorine type may be filled in the outdoor circuit (11). As the natural refrigerant, $CO_2$, $C_mH_n$, $NH_3$, $H_2O$, and the like can be listed.

In the outdoor circuit (11), the discharge side of the compressor (21) is connected to a first port of the four-way switch valve (23) via the oil separator (22). A second port of the four-way switch valve (23) is connected to one end of the outdoor heat exchanger (24). A third port of the four-way switch valve (23) is connected to the suction side of the compressor (21) via a recovery container (40) described later. A fourth port of the four-way switch valve (23) is connected to a gas side closing valve (27). The other end of the outdoor heat exchanger (24) is connected to a liquid side closing valve (26) through an outdoor expansion valve (25).

The compressor (21) is a hermetic scroll compressor. Also, the compressor (21) is of high pressure dome type. In detail, the compressor (21) is so composed that a gas refrigerant compressed in a compression mechanism (21*b*) is once flown in a casing (21*a*) and then is flown out from the casing (21*a*). Refrigerating machine oil for the HFC refrigerant is trapped at the bottom of the casing (21*a*). Synthesized oil such as Ester oil, ester oil, and the like are used as the refrigerating machine oil.

The compressor (21) is set variable in capacity. Electric power is supplied to a motor (21*c*) of the compressor (21) through an inverter (not shown). When the output frequency of the inverter is changed, the rotation velocity of the motor (21*c*) changes to change the capacity of the compressor (21).

The refrigerant circuit (10) is so composed that exchange between cooling mode operation and heating mode operation is performed by switching the four-way switch valve (23). Specifically, when a state is switched to a state that the first port and the second port of the four-way switch valve (23) communicate with each other while the third port and the fourth port communicate with each other (the state shown in solid lines in FIG. 1), the outdoor heat exchanger (24) functions as a condenser while the indoor heat exchanger (33) functions as an evaporator in the refrigerant circuit (10), whereby the refrigerant is circulated in the cooling mode operation. To the contrary, when the state is switched to a state that the first port and the fourth port of the four-way switch valve (23) communicate with each other while the second port and the third port communicate with each other (the state shown in broken lines in FIG. 1), the outdoor heat exchanger (24) functions as an evaporator while the indoor heat exchanger (33) functions as a condenser in the refrigerant circuit (10), whereby the refrigerant is circulated in the heating mode operation.

The outdoor circuit (11) is provided with the recovery container (40) that recovers foreign matters such as mineral oil of the refrigerating machine oil for the old refrigerant remaining in the existing liquid side communication pipe (60) and the existing gas side communication pipe (70). The recovery container (40) is hermetic and is connected to a flow-in pipe (41) and a flow-out pipe (42). The flow-in pipe (41) is connected to the third port of the four-way switch valve (23). The flow-out pipe (42) is connected to the suction side of the compressor (21).

The flow-in pipe (41) is arranged at an outlet end thereof at the bottom in the recovery container (40) so as to open toward the bottom of the recovery container (40). The flow-in pipe (41) is provided with a flow-in valve (51). On the other hand, the flow-out pipe (42) is arranged at an inlet end thereof in the upper part in the recovery container (40) so as to open toward the bottom of the recovery container (40). The flow-out pipe (42) is provided with a flow-out valve (52). Each of the flow-in valve (51) and the flow-out valve (52) composes a switch valve.

The outdoor circuit (11) is provided with a bypass pipe (54) for bypassing the recovery container (40). The bypass pipe (54) is connected at one end thereof between the flow-in valve (51) and the third port of the four-way switch valve (23) and is connected at the other end thereof between the flow-out valve (52) and the suction side of the compressor (21). The bypass pipe (54) is provided with a bypass valve (53) serving as a switch valve.

To the oil separator (22), one end of an oil return pipe (22*a*) is connected. The other end of the oil return pipe (22*a*) is connected between the flow-out valve (52) and the suction side of the compressor (21) on further downstream side than a part where the bypass pipe (54) is connected. The synthesized oil discharged from the compressor (21) together with the gas refrigerant is separated from the gas refrigerant by the oil separator (22), and then, is returned to the suction side of the compressor (21) through the oil return pipe (22*a*).

In the indoor circuit (12) of the indoor unit (30), an indoor expansion valve (32) and an indoor heat exchanger (33) serving as a user side heat exchanger are connected with each other in series. The indoor unit (30) is provided also with an indoor fan (33*a*).

The liquid side communication pipe (60) is connected at one end thereof to the outdoor circuit (11) through a liquid side closing valve (26). The other end of the liquid side communication pipe (60) is connected to the indoor circuit (12) of the indoor unit (30) by means of a liquid side connector (31). Further, the gas side communication pipe (70) is connected at one end thereof to the outdoor circuit (11) through a gas side closing valve (27). The other end of the gas side communication pipe (70) is connected to the indoor circuit (12) of the indoor unit (30) by means of a gas side connector (34)

In the air conditioner of the present embodiment, the capacity of the compressor (21) in the cleaning operation is set based on Froude number Fr expressed by the following expression.

$$Fr=(d_g/d_l)\times(U^2/gD) \quad \text{(Expression 1)}$$

In the above expression, the Froude number Fr is a dimensionless number expressing a ratio of an inertial force of the gas refrigerant flowing through the gas side communication pipe (70) to a gravity working on a liquid in the gas side communication pipe (70). In the expression, U is a velocity of the gas refrigerant flowing thought the gas side communication pipe (70) and its unit is [m/s]. D is an inner diameter of the gas side communication pipe (70) and its unit is [m]. $d_g$ is a density of the gas refrigerant flowing through the gas side communication pipe (70) and its unit is [kg/m$^3$]. $d_l$ is a density of the liquid existing in the gas side communication pipe (70) and its unit is [kg/m$^3$]. g is a gravitational acceleration and its unit is [m/s$^2$].

During the cleaning operation, mineral oil (the refrigerating machine oil for the old refrigerant), the new refrigerant, the synthesized oil (the refrigerating machine oil for the new refrigerant), and solid-state or liquid-state foreign matters exist in the gas side communication pipe (70) in a mixed state. The solid-state or liquid-state foreign matters include detrital powder generated due to sliding of the compressor (21), various kinds of acids and ions generated due to degradation of the mineral oil and the old refrigerant, and moisture that has been penetrated in the piping. The mixture of the mineral oil, the new refrigerant, the synthesized oil, and the various kinds of foreign matters are pushed and flown by the gas refrigerant during the cleaning operation.

Wherein, it is difficult or impossible to estimate and measure each rate of the components of the mixture existing in the gas side communication pipe (70). Further, each rate of the components of the mixture varies moment to moment during the cleaning operation. Under the circumstances, it is desirable to use the largest value that can be estimated as the density $d_l$ of the liquid existing in the gas side communication pipe (70).

Specifically, the liquid that can exist in the gas side communication pipe (70) are the mineral oil, the new refrigerant, and the synthesized oil. In view that the amount of the foreign matters such as detrital powder is not so large, the largest density value among the mineral oil, the new refrigerant, and the synthesized oil is desirably used as a value of the density $d_l$ of the liquid used in introducing the Froude number Fr. For example, when R410A is used as the new refrigerant, the density of R410A in a liquid state is the largest of the three. Accordingly, it is desirable to use the density of the liquid-state R410A as the value of the density $d_l$ of the liquid in this case.

In the cleaning operation, the Froude number Fr may be set based on openings of the outdoor expansion valve (32) and the indoor expansion valve (25) which are provided in the refrigerant circuit (10) or flow rates of the outdoor fan (24*a*) and the indoor fan (33*a*) which are provided in the refrigerant circuit (10). When the openings of the expansion valves (25, 32) or the flow rates of the fans (24*a*, 33*a*) are determined, a refrigerant circulation rate in the refrigerant circuit (10) is determined to determine the velocity of the gas refrigerant flowing through the gas side communication pipe (70).

Method for Replacing Indoor and Outdoor Units

In renewal of an air conditioner using the CFC refrigerant or the HCFC refrigerant as the old refrigerant, the existing liquid side communication pipe (60) and the existing gas side communication pipe (70) are used as they are and the existing outdoor unit and the existing indoor unit are replaced to the new outdoor unit (20) and the new indoor unit (30) for the HFC refrigerant as the new refrigerant.

Specifically, the CFC refrigerant or the HCFC refrigerant is recovered from the air conditioner first. Then, the existing outdoor unit and the existing indoor unit for the CFC refrigerant or the HCFC refrigerant are removed from the existing liquid side communication pipe (60) and the existing gas side communication pipe (70). Subsequently, the outdoor unit (20) and the indoor unit (30) for the HFC refrigerant are connected to the existing liquid side communication pipe (60) and the gas side communication pipe (70) by means of the connectors (31, 34) with intervention of the closing valves (26, 27) to form the aforementioned refrigerant circuit (10).

Next, under the condition that the liquid side closing valve (26) and the gas side closing valve (27) are closed, the indoor unit (30), the liquid side communication pipe (60), and the gas side communication pipe (70) are vacuumed to remove air, moisture, and the like in the refrigerant circuit (10) except the outdoor unit (20). Then, the liquid side closing valve (26) and the gas side closing valve (27) are opened, and the HFC refrigerant is added and filled in the refrigerant circuit (10).

Cleaning Operation

The cleaning operation of the aforementioned air conditioner will be described next. The cleaning operation is performed for removing foreign matters such as mineral oil remaining in the existing liquid side communication pipe (60) and the existing gas side communication pipe (70), and is performed immediately after installation of the indoor unit (30) an the outdoor unit (20) for the HFC refrigerant.

After installation of the indoor unit (30) and the outdoor unit (20) for the HFC refrigerant, the compressor (21) is started operating and the four-way switch valve (23) is switched to the state indicated by the solid lines in FIG. 1. Further, the flow-in valve (51) and the flow-out valve (52) are opened while the bypass valve (53) is closed. Wherein, during the cleaning operation, each opening of the outdoor expansion valve (25) and the indoor expansion valve (32) is adjusted appropriately.

When the compressor (21) is operated, the compressed gas refrigerant is discharged from the compressor (21). The thus discharged gas refrigerant flows to the four-way switch valve (23) via the oil separator (22). The gas refrigerant after passing through the four-way switch valve (23) flows into the outdoor heat exchanger (24) to be heat-exchanged with outdoor air, thereby being condense. Then, the condensed liquid refrigerant passes through the outdoor expansion valve (25) and flows into the liquid side communicating pipe (60) through the liquid side closing valve (26).

In the liquid side communication pipe (60), the mineral oil of the refrigerating machine oil for the old refrigerant and the foreign matters remain. The mineral oil and the foreign matters are pushed and flown by the liquid refrigerant flowing in the liquid side communication pipe (60). Then, the mixture of the liquid refrigerant and a liquid containing the mineral oil and the foreign matters flows into the indoor heat exchanger (33) through the indoor expansion valve (32). In the indoor heat exchanger (33), the liquid refrigerant is heat-exchanged with indoor air to be evaporated. The evaporated refrigerant flows into the gas side communication pipe (70) together with the liquid containing the mineral oil and the foreign matters.

In the gas side communication pipe (70), the mineral oil of the refrigerating machine oil for the old refrigerant and the foreign matters remain. The mineral oil and the foreign matters are pushed and flown by the gas refrigerant together with the liquid containing the mineral oil and the foreign matters flown from the liquid side communication pipe (60). Then, the mixture of the gas refrigerant and the liquid containing the mineral oil and the foreign matters passes through the gas side closing valve (27) and the four-way switch valve (23) to flow into the recovery container (40) through the flow-in pipe (41).

The mixture of the gas refrigerant and the liquid containing the mineral oil and the foreign matters which has flown in the recovery container (40) is discharged toward the bottom of the recovery container (40). The liquid containing the mineral oil and the foreign matters out of the mixture is trapped at the bottom of the recovery container (40). The gas refrigerant flows out from the recovery container (40) to the refrigerant circuit (10) through the flow-out pipe (42), and then, flows into the compressor (21) from the suction side of the compressor (21).

The aforementioned cleaning operation for a predetermine time period causes the liquid containing the mineral oil and the foreign matters and remaining in the existing liquid side communication pipe (60) and the existing gas side communication pipe (70) to be recovered into the recovery container (40) together with the gas refrigerant flowing in the refrigerant circuit (10), thereby removing the mineral oil of the refrigerating machine oil for the old refrigerant and the foreign matters from the liquid side communication pipe (60) and the gas side communication pipe (70).

After the cleaning operation, the flow-in valve (51) and the flow-out valve (51) are closed and the bypass valve (53) is closed. Thereafter, the flow-in valve (51) and the flow-out valve (52) are closed all the time while the bypass valve (53) is opened all the time. Under this condition, normal operation is exchanged between the cooling mode operation and the heating mode operation.

Cooling Mode Operation and Heating Mode Operation

In the cooling mode operation, the four-way switch valve (23) is in the state shown as the solid lines in FIG. 1. The refrigerant discharged from the compressor (21) flows into the oil separator (22), passes through the four-way switch valve (23), and then, is heat-exchanged with outdoor air by the outdoor heat exchanger (24) to be condensed. The condensed refrigerant passes through the outdoor expansion valve (25), flows through the liquid side communication pipe (60), and then, is heat-exchanged with indoor air by the indoor heat exchanger (33) to be evaporated. The evaporated refrigerant flows through the gas side communication pipe (70) and passes through the four-way switch valve (23) and the bypass pipe (54) to be returned to the suction side of the compressor (21).

On the other hand, in the heating mode operation, the four-way switch valve (23) is in the state shown as the broken lines in FIG. 1. The refrigerant discharged from the compressor (21) flows into the oil separator (22), passes through the four-way switch valve (23) and the gas side communication pipe (70), and then, is heat-exchanged with indoor air by the indoor heat exchanger (33) to be condensed. The condensed refrigerant flows through the liquid side communication pipe (60), passes through the outdoor expansion valve (25), and then, is heat-exchanged with outdoor air by the outdoor heat exchanger (24) to be evaporated. The evaporated refrigerant passes through the four-way switch valve (23) and the bypass pipe (54) to be returned to the suction side of the compressor (21).

Operation Condition in Cleaning Operation

As described above, during the cleaning operation of the aforementioned air conditioner, the liquid containing the mineral oil and the foreign matters and remaining in the existing liquid side communication pipe (60) and the existing gas side communication pipe (70) is pushed and flown by the refrigerant flowing in the refrigerant circuit (10) to be recovered in the recovery container (40). It is noted that during the cleaning operation, it is possible to perform dry operation in which the refrigerant flowing through the gas side communication pipe (70) is in a vapor phase only or to perform wet operation in which the refrigerant flowing in the gas side communication pipe (70) is in two phases of vapor and liquid.

In the aforementioned air conditioner, the outdoor unit (20) is arranged at an upper level than the indoor unit (30). In this case, the liquid side communication pipe (60) and the gas side communication pipe (70) are arranged in a perpendicular direction. In the cleaning operation of the thus arranged air conditioner, the liquid refrigerant flows downward through the liquid side communication pipe (60) while the gas refrigerant flows upward through the gas side communication pipe (70).

In the air conditioner according to the present embodiment, the capacity of the compressor (21) in the cleaning operation is set so that the Froude number Fr is larger than 1. Under the condition, the inertial force of the gas refrigerant flowing through the gas side communication pipe (70) is larger than the gravity working on the liquid containing the mineral oil and the foreign matters and remaining in the gas side communication pipe (70). In other words, the resultant force affecting on the liquid containing the mineral oil and the foreign matters becomes upward in the perpendicularly extending portion of the gas side communication pipe (70). Accordingly, the liquid containing the mineral oil and the foreign matters is pushed up by the gas refrigerant even in the perpendicularly extending portion of the gas side communication pipe (70). In this way, the liquid containing the mineral oil and the foreign matters and remaining in the existing gas side communication pipe (70) is removed from the existing gas side communication pipe (70) by the cleaning operation. Then, the liquid containing the mineral oil and the foreign matters removed from the existing gas side communication pipe (70) is recovered surely to the recovery container (40).

The old refrigerant and the mineral oil of the refrigerating machine oil for the old refrigerant are solved in each other to flow through the liquid side communication pipe (60) while the foreign matters are flown with the liquid-phase old refrigerant. Therefore, the amount of the mineral oil and the foreign matters which remain in the liquid side communication pipe (60) is very small. Further, the liquid refrigerant flows downward through the liquid side communication pipe (60) during the cleaning operation. Accordingly, the mineral oil and the foreign matters remaining in the liquid side communication pipe (60) is pushed and flown downward by the liquid refrigerant. Under the circumstances, when the Froude number Fr in the gas side communication pipe (70) is taken into consideration, the mineral oil and the foreign matters can be removed surely also from the liquid side communication pipe (60).

In the air conditioner according to the present embodiment, the capacity of the compressor (21) in the cleaning operation is set so that the Froude number Fr in the gas side communication pipe (70) is larger than 1. The reason why it is so set will be described with reference to FIG. 2.

Figure 2:
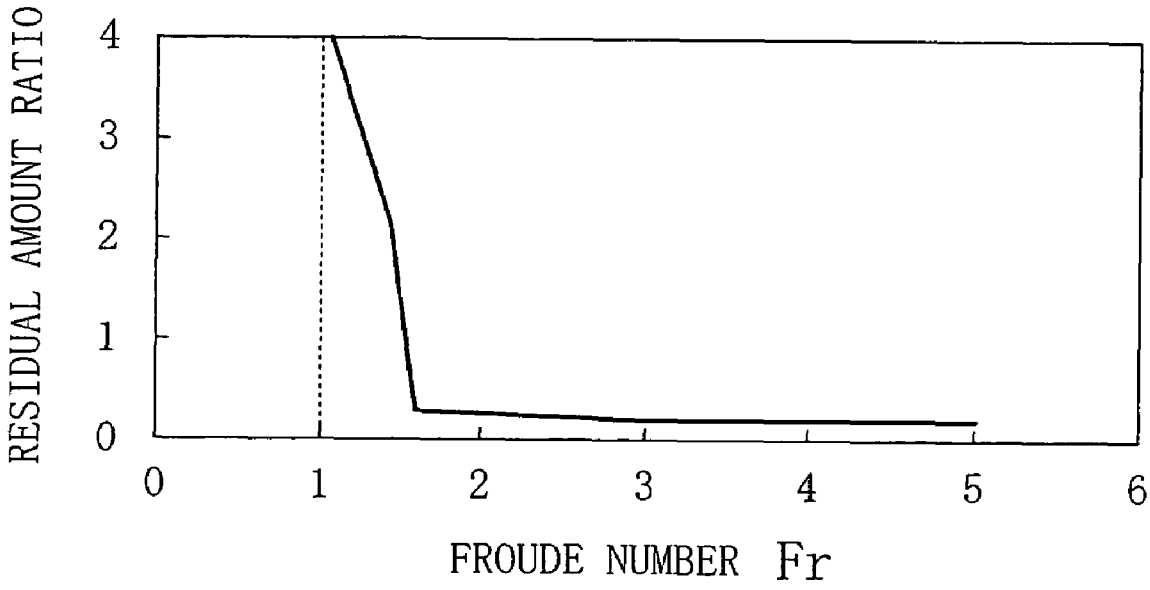
FIG. 2 is a graph indicating the relationship between Froude number Fr and a residual amount ratio.
Figure 3:
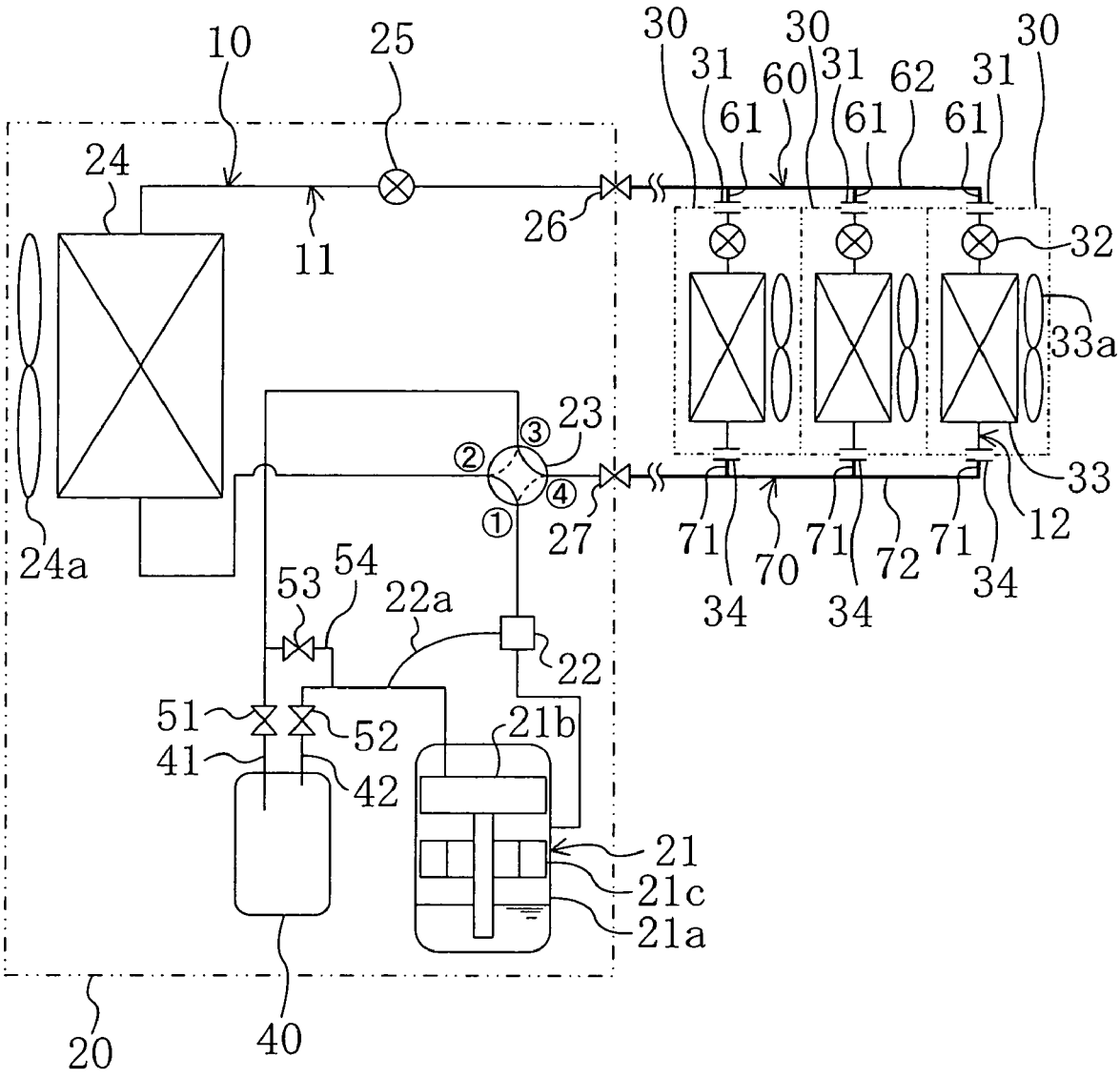
FIG. 3 is a diagram showing a refrigerant circuit of an air conditioner according to Embodiment 2.

In FIG. 2, the axis of abscissas indicates the Froude number Fr expressed by Expression 1 while the axis of ordinates indicates a residual amount ratio. The residual amount ratio means a ratio of an amount of the mineral oil and the foreign matters which remain in the liquid side communication pipe (60) and the gas side communication pipe (70) after one- to three-hour cleaning operation to a standard value, wherein the standard value is a tolerable amount of the mineral oil and the foreign matters which remain in the liquid side communication pipe (60) and the gas side communication pipe (70).

As shown in FIG. 2, the residual amount ratio decreases as the Froude number Fr becomes larger in the range where the Froude number is larger than 1. Because, the difference between the inertial force of the gas refrigerant and the gravity working on the liquid containing the mineral oil and the foreign matters becomes larger as the Froude number Fr becomes larger, so that the force that the liquid containing the mineral oil and the foreign matters receives from the gas refrigerant increases. Further, the gradient of the residual amount ratio to the Froude number Fr becomes further larger in the range where the Froude number Fr is 1.4 or larger, and the residual amount ratio becomes 1 or smaller in the range where the Froude number Fr is 1.5 or larger. Furthermore, the residual amount ratio becomes about 0.3 at the point where the Froude number Fr is 1.6, and the residual amount ratio decreases very gently in the range where the Froude number is 1.6 or larger.

In this way, in the range where the Froude number is in the range between 1 and 1.5, the residual amount ratio after performing the cleaning operation for one to three hours becomes larger than 1. In other words, after the cleaning operation, a larger amount of the mineral oil and the foreign matters than the tolerable amount remain in the liquid side communication pipe (60) and the gas side communication pipe (70). However, if the cleaning operation is performed further longer, the residual amount ratio can be reduced to 1 or smaller, achieving reduction of the amount of the mineral oil and the foreign matters which remain in the liquid side communication pipe (60) and the gas side communication pipe (70) to an amount less than the tolerable amount.

In view of the above, the capacity of the compressor (21) is set so that the Froude number Fr is smaller than 1. Further, it is desirable to set the capacity of the compressor (21) so that the Froude number Fr is 1.5 or larger, and it is the most desirable to set it so that the Froude number Fr is about 1.6.

Wherein, in the aforementioned cleaning operation, the capacity of the compressor (21) is set so that the upper limit of the Froude number Fr is 120. Also, under the condition that the capacity of the compressor (21) is set so that the Froude number Fr is 1.5 or larger, the cleaning operation for the existing liquid side communication pipe (60) and the existing gas side communicating pipe (70) to reduce the residual amount ratio to 1 or smaller can be completed within only one to three hours even in the case where operation conditions such as an outdoor air condition and the like are different.

Wherein, the capacity of the compressor (21) in the cleaning operation is set beforehand in the step of designing the air conditioner so that the Froude number Fr is larger than 1 even under the severest condition that is assumable. The severest condition is an operation condition that the density $d_g$ of the gas refrigerant in the gas side communication pipe (70) is the smallest while the density $d_l$ of the liquid refrigerant in the gas side communication pipe (70) is the largest among assumable operation conditions. Further, as a value of the density $d_l$ of the liquid refrigerant, the largest value of the densities of the liquid components that can exist in the gas side communication pipe (70) is used. The thus set value of the density $d_l$ necessarily becomes larger than the density of the liquid refrigerant existing in the gas side communication pipe (70). When the compressor (21) with the capacity in the cleaning operation so set as above is operated, the Froude number Fr in the gas side communication pipe (70) surely becomes larger than 1 so that the liquid refrigerant in the gas side communication pipe (70) is pushed and flown by the gas refrigerant surely.

Wherein, the values of the density $d_g$ of the gas refrigerant and the density $d_l$ of the liquid refrigerant vary depending on temperature and pressure. In this viewpoint, the air conditioner according to the present embodiment corrects the predetermined set value of the capacity of the compressor (21) in the cleaning operation, taking account of actually measured values and estimated values of temperature and pressure at the time when the actual cleaning operation is performed.

It is noted that it is possible that the capacity of the compressor (21) which is suitable for the cleaning operation is stored for each of plural operation conditions and a capacity suitable for an operation condition at the actual cleaning operation is selected among the plurality of stored set values. In this case, tests under various operation conditions are performed in the step of designing the air conditioner to determine the capacity of the compressor (21) which enables sure cleaning of the gas side communication pipe (70) by the cleaning operation under each operation condition and the determined values are stored in the air conditioner.

Effects of Embodiment 1

In the present embodiment, the capacity of the compressor (21) in the cleaning operation is set based on the Froude number Fr. In detail, the capacity of the compressor (21) in the cleaning operation is set taking account of the Froude number Fr that expresses the relationship between the gravity working on the liquid in the gas side communication pipe (70) and the inertial force of the gas refrigerant flowing through the gas side communication pipe (70).

The old refrigerant and the mineral oil of the refrigerating machine oil for the old refrigerant are solved in each other to flow through the liquid side communication pipe (60) while the foreign matters are flown with the liquid-phase old refrigerant. Therefore, the amount of the mineral oil and the foreign matters which remain in the liquid side communication pipe (60) is very small. The liquid refrigerant flowing through the liquid side communication pipe (60) has a specific gravity larger than the gas refrigerant flowing through the gas side communication pipe (70) and the inertial force of the liquid refrigerant is larger than the inertial force of the gas refrigerant. Accordingly, if the mineral oil and the foreign matters which remain in the gas side communication pipe (70) can be pushed and flown, the mineral oil and the foreign matters which remain in the liquid side communication pipe (60) can be also pushed and flown.

Accordingly, when the capacity of the compressor (21) is set based on the Froude number Fr relating to the liquid and the gas refrigerant in the gas side communication pipe (70), the liquid containing the mineral oil and the foreign matters and remaining in the liquid side communication pipe (60) and the gas side communication pipe (70) can be pushed and flown by the refrigerant to be recovered to the recovery container (40). Hence, according to the present embodiment, the residual amount of the mineral oil and the foreign matters which remain in the existing liquid side communication pipe (60) and the existing gas side communication pipe (70) can be reduced surely by the cleaning operation, obviating troubles caused due to the existence of the mineral oil.

In the present embodiment, also, the capacity of the compressor (21) in the cleaning operation is set so that the Froude number Fr is larger than 1. Under this condition, the inertial force of the gas refrigerant flowing through the gas side communication pipe (70) becomes larger than the gravity working on the liquid containing the mineral oil and the foreign matters and remaining in the gas side communication pipe (70) to cause the gas refrigerant to push upward the liquid containing the mineral oil and the foreign matters even in the perpendicularly extending portion of the gas side communication pipe (70). Hence, according to the present embodiment, the residual amount of the mineral oil and the foreign matters in the existing liquid side communication pipe (60) and the existing gas side communication pipe (70) can be reduced further.

Moreover, when the capacity of the compressor (21) in the cleaning operation is set so that the Froude number Fr is 1.5 or lager, the inertial force of the gas refrigerant flowing through the gas side communication pipe (70) is 1.5 times or further larger than the gravity working on the liquid containing the mineral oil and the foreign matters and remaining in the gas side communication pipe (70) so that the force of the gas refrigerant for pushing the liquid containing the mineral oil and the foreign matters upward increases even at the perpendicularly extending portion of the gas side communication pipe (70). Therefore, one- to three-hour cleaning operation can surely reduce the residual amount of the mineral oil and the foreign matters in the existing liquid side communication pipe (60) and the existing gas side communication pipe (70).

Modified Example of Embodiment 1

In Embodiment 1, one compressor (21) is provided and the output frequency of the inverter is adjusted to set the capacity of the compressor (21). Beside the above, it is possible that a plurality of compressors (21) are provided and the number of compressors (21) under operation is changed to set the capacity of the compressors (21).

Embodiment 2

Embodiment 2 of the present invention will be described. In the present embodiment, the constitution of the air conditioner in Embodiment 1 is changed. Herein, the subject matter of the present embodiment different from Embodiment 1 will be described.

In Embodiment 2 of the present embodiment, the constitution of the air conditioner in Embodiment 1 is changed. Herein, the subject matter of the present embodiment different from Embodiment 1 will be described.

The air conditioner in the present embodiment includes one outdoor unit (20) and three indoor unit (30, 30, 30). Wherein, the number of the indoor units (30) is a mere example. An indoor circuit (12) is provided in each of the indoor units (30). An outdoor circuit (11) of the outdoor unit (20) and each indoor circuit (12) of the indoor units (30) are connected with each other by means of the existing liquid side communication pipe (60) and a gas side communication pipe (70) to compose a refrigerant circuit (10).

In each indoor circuit (12) of the indoor units (12), an indoor expansion valve (32) and an indoor heat exchanger (33) are connected with each other in series. Each indoor unit (30) is provided with an indoor fan (33*a*).

The liquid side communication pipe (60) is composed of one stem pipe (62) and three branch pipes (61, 61, 61). The stem pipe (62) of the liquid side communication pipe (60) is connected at one end thereof to the outdoor circuit (11) through a liquid side closing valve (26). Also, the stem pipe (62) of the liquid side communication pipe (60) is connected to the three branch pipes (61, 61, 61). The branch pipes (61, 61, 61) of the liquid side communication pipe (60) are connected to the indoor circuits (12) of the indoor units (30) by means of liquid side connectors (31), respectively.

The aforementioned gas side communicating pipe (70) is composed of one stem pipe (72) and three branch pipes (71, 71, 71). The stem pipe (72) of the gas side communication pipe (70) is connected at one end thereof to the outdoor circuit (11) through a gas side closing valve (26). Also, the stem pipe (72) of the gas side communication pipe (70) is connected to the three branch pipes (71, 71, 71). The branch pipes (71, 71, 71) of the gas side communication pipe (70) are connected to the indoor circuits (12) of the indoor units (30) by means of gas side connectors (34), respectively.

In the air conditioner according to the present embodiment, the capacity of the compressor (21) in the cleaning operation is set based on the Froude number Fr expressed by Expression 1, likewise Embodiment 1. Wherein, the definition of U, D, $d_g$, and $d_l$ in the present embodiment is different from that in Embodiment 1. Specifically, U is a velocity of the gas refrigerant flowing through the stem pipe (72) of the gas side communication pipe (70). D is an inner diameter of the stem pipe (72) of the gas side communication pipe (70). $d_g$ is a density of the gas refrigerant flowing through the stem pipe (72) of the gas side communication pipe (70). $d_l$ is a density of the liquid existing in the stem pipe (72) of the gas side communication pipe (70).

In the case, for example, where the outdoor unit (20) is arranged on a roof of a building while the indoor units (30) are arranged on respective floors inside the building, it is general that the branch pipes (71, 71, 71) of the gas side communication pipe (70) are arranged along the respective ceilings horizontally while the stem pipe (72) thereof is arranged in the perpendicular direction. With such arrangement, the mineral oil and the foreign matters can be removed surely from the branch pipes (71, 71, 71) by taking account of the Froude number Fr in the stem pipe (72) of the gas side communication pipe (70).

In the air conditioner according to the present embodiment, the capacity of the compressor (21) in the cleaning operation is set so that the Froude number is larger than 1. Under this condition, the inertial force of the gas refrigerant flowing through the stem pipe (72) becomes larger than the gravity working on the liquid containing the mineral oil and the foreign matters and remaining in the stem pipe (72) of the gas side communication pipe (70). In other words, the resultant force affecting on the liquid containing the mineral oil and the foreign matters becomes upward in the stem pipe (72) of the gas side communication pipe (70). In this connection, the liquid containing the mineral oil and the foreign matters is pushed up by the gas refrigerant even in the perpendicularly extending stem pipe (72) of the gas side communication pipe (70). In this way, the liquid containing the mineral oil and the foreign matters and remaining in the existing gas side communication pipe (70) is removed from the existing gas side communication pipe (70) by the cleaning operation. Then, the liquid containing the mineral oil and the foreign matters which has been removed from the existing gas side communication pipe (70) is recovered to the recovery container (40) surely.

It is noted that the capacity of the compressor (21) may be set so that the Froude number Fr is larger than 1 in both the stem pipe (72) and the branch pipes (71, 71, 71) of the gas side communication pipe (70).

In the present embodiment, the capacity of the compressor (21) in the cleaning operation is set taking account of the Froude number Fr that expresses the relationship between the gravity working on the liquid in the gas side communication pipe (70) and the gas refrigerant flowing through the stem pipe (72) thereof.

As described above, if the mineral oil and the foreign matters which remain in the gas side communication pipe (70) can be flown out, the mineral oil and the foreign matters which remain in the liquid side communication pipe (60) can be flown out, also. Accordingly, when the capacity of the compressor (21) is set based on the Froude number Fr relating to the liquid and the gas refrigerant in the stem pipe (72) of the gas side communication pipe (70), the liquid containing the mineral oil and the foreign matters and remaining in the liquid side communication pipe (60) and the stem pipe (72) and the branch pipes (71, 71, 71) of the gas side communication pipe (70) can be pushed and flown by the refrigerant surely to be recovered into the recovery container (40). Hence, according to the present embodiment, the residual amount of the mineral oil and the foreign matters in the existing liquid side communication pipe (60) and the existing gas side communication pipe (70) can be reduced surely by the cleaning operation even in the case where the plurality of indoor heat exchangers (33) are connected to the refrigerating apparatus, obviating troubles caused due to the existence of the mineral oil.

INDUSTRIAL APPLICABILITY

As described above, the present invention relates to a refrigerating apparatus connected to existing communication pipes and is useful for performing cleaning operation of the communication pipes.

The invention claimed is:

1. A refrigerating apparatus comprising:

a heat source side circuit (11) which is provided with a compressor (21) and a heat source side heat exchanger (24) and which is connected to a user side heat exchanger (33) by means of an existing liquid side communication pipe (60) and an existing gas side communication pipe (70), the refrigerating apparatus performing cleaning operation for removing refrigerating machine oil for an old refrigerant from the existing liquid side communication pipe (60) and the existing gas side communication pipe (70) by operating the compressor (21), wherein an operation condition in the cleaning operation is set based on a Froude number Fr expressed by an expression $Fr=(d_g/d_l)\times(U^2/gD)$ where U is a velocity of a gas refrigerant flowing through the gas side communication pipe (70), D is an inner diameter of the gas side communication pipe (70), $d_g$ is a density of the gas refrigerant flowing through the gas side communication pipe (70), $d_l$ is a density of a liquid existing in the gas side communication pipe (70), and g is a gravitational acceleration.

2. A refrigerating apparatus comprising:

a heat source side circuit (11) which is provided with a compressor (21) and a heat source side heat exchanger (24) and which is connected to user side heat exchangers (33) by means of an existing liquid side communication pipe (60) and an existing gas side communication pipe (70), the refrigerating apparatus performing cleaning operation for removing refrigerating machine oil for an old refrigerant from the existing liquid side communication pipe (60) and the existing gas side communication pipe (70) by operating the compressor (21), wherein the gas side communication pipe (70) which is connected to the heat source side circuit (11) of the refrigerant apparatus is composed of a plurality of branch pipes (71) respectively connected to the plurality of user side heat exchangers, and a stem pipe (72) to which the plurality of branch pipes (71) are connected, and an operation condition in the cleaning operation is set based on a Froude number Fr expressed by an expression $Fr=(d_g/d_l)\times(U^2/gD)$ where U is a velocity of a gas refrigerant flowing through the stem pipe (72) of the gas side communication pipe (70), D is an inner diameter of the stem pipe (72), $d_g$ is a density of the gas refrigerant flowing through the stem pipe (72), $d_l$ is a density of a liquid existing in the stem pipe (72), and g is a gravitational acceleration.

3. A refrigerating apparatus comprising:

a heat source side circuit (11) which is provided with a compressor (21) and a heat source side heat exchanger (24) and which is connected to a user side heat exchanger (33) by means of an existing liquid side communication pipe (60) and an existing gas side communication pipe (70); and a recovery container (40) which is provided on a suction side of the compressor (21) in the heat source side circuit (11) and which traps refrigerating machine oil separated from the gas refrigerant, the refrigerating apparatus performing cleaning operation for recovering refrigerating machine oil for the old refrigerant remaining in the existing liquid side communication pipe (60) and the existing gas side communication pipe (70) to the recovery container (40) by operating the compressor (21), wherein an operation condition during the cleaning operation is set based on a Froude number Fr expressed by an expression $Fr=(d_g/d_l)\times(U^2/gD)$ where U is a velocity of a gas refrigerant flowing through the gas side communication pipe (70), D is an inner diameter of the gas side communication pipe (70), $d_g$ is a density of the gas refrigerant flowing through the gas side communication pipe (70), $d_l$ is a density of a liquid existing in the gas side communication pipe (70), and g is a gravitational acceleration.

4. A refrigerating apparatus comprising:

a heat source side circuit (11) which is provided with a compressor (21) and a heat source side heat exchanger (24) and which is connected to user side heat exchangers (33) by means of an existing liquid side communication pipe (60) and an existing gas side communication pipe (70); and a recovery container (40) which is provided on a suction side of the compressor (21) in the heat source side circuit (11) and which traps refrigerating machine oil separated from the gas refrigerant, the refrigerating apparatus performing cleaning operation for recovering refrigerating machine oil for the old refrigerant remaining in the existing liquid side communication pipe (60) and the existing gas side communication pipe (70) to the recovery container (40) by operating the compressor (21), wherein the gas side communication pipe (70) which is connected to the heat source side circuit (11) of the refrigerant apparatus is composed of a plurality of branch pipes (71) respectively connected to the plurality of user side heat exchangers, and a stem pipe (72) to which the plurality of branch pipes (71) are connected, and an operation condition in the cleaning operation is set based on a Froude number Fr expressed by an expression $Fr=(d_g/d_l)\times(U^2/gD)$ where U is a velocity of a gas refrigerant flowing through the stem pipe (72) of the gas side communication pipe (70), D is an inner diameter of the stem pipe (72), $d_g$ is a density of the gas refrigerant flowing through the stem pipe (72), $d_l$ is a density of a liquid existing in the stem pipe (72), and g is a gravitational acceleration.

5. The refrigerating apparatus of any one of claims 1, 2, 3, and 4, wherein the operation condition in the cleaning operation is set so that the Froude number is larger than 1.

6. The refrigerating apparatus of any one of claims 1, 2, 3, and 4, wherein the operation condition in the cleaning operation is set so that the Froude number is 1.5 or larger.

7. The refrigerating apparatus of any one of claims 1, 2, 3, and 4, wherein the refrigerant filled in the heat source side circuit (11) is a mixed refrigerant containing R32 or a natural refrigerant.

* * * * *